United States Patent [19]

Held et al.

[11] Patent Number: 4,806,177

[45] Date of Patent: Feb. 21, 1989

[54] AS-HOT ROLLED BAR STEEL

[75] Inventors: John F. Held, Hudson; Barry A. Lauer, Macedonia, both of Ohio

[73] Assignee: LTV Steel Company, Inc., Cleveland, Ohio

[21] Appl. No.: 69,869

[22] Filed: Jul. 6, 1987

[51] Int. Cl.[4] ..... C22C 38/12

[52] U.S. Cl. ..... 148/320; 420/127; 420/128; 420/87

[58] Field of Search ..... 148/320, 328, 909, 12 B, 148/12 F; 420/87, 103, 127, 128; 428/586

[56] References Cited

U.S. PATENT DOCUMENTS

| | | | |
|---|---|---|---|
| Re. 28,878 | 6/1976 | Korchynsky et al. | 148/320 |
| 3,173,782 | 3/1965 | Melloy et al. | 148/320 |
| 3,562,028 | 2/1971 | Heitmann et al. | 148/320 |
| 3,761,324 | 9/1973 | Elias et al. | 148/320 |
| 4,142,922 | 3/1979 | Abraham et al. | 148/320 |
| 4,289,548 | 9/1981 | Bucher et al. | 148/12 B |
| 4,370,178 | 1/1983 | Waid et al. | 148/12 R |
| 4,397,698 | 8/1983 | Davenport et al. | 148/12 R |
| 4,405,381 | 9/1983 | Demianczuk et al. | 148/12 B |

FOREIGN PATENT DOCUMENTS

| | | | |
|---|---|---|---|
| 58-1354 | 4/1983 | Japan | 148/320 |

OTHER PUBLICATIONS

"Production of Microalloyed Strip and Plate By Controlled Cooling" by John D. Grozier; *Microalloying* 75.

"The Combined Effect of Microalloying Steels with Columbium and Vanadium" Greday et al; *Microalloying* 75, LTV Microalloyed Steels: (Mar. 1986).

*Primary Examiner*—Deborah Yee

*Attorney, Agent, or Firm*—Watts, Hoffmann, Fisher & Heinke

[57] ABSTRACT

The toughness of vanadium and niobium microalloyed medium carbon bar steels is significantly improved by a controlled addition of aluminum in a range of from about 0.05 to 0.11 percent. Forged parts combining high strength and hardness properties with improved toughness can be made from the new bar steel without the need of heat treatment.

7 Claims, 2 Drawing Sheets

AS-HOT ROLLED BAR STEEL

DESCRIPTION

1. Technical Field

The present invention relates generally to forging grade bar steels, and more specifically to microalloyed medium carbon hot rolled bar steels which combine the properties of good strength and hardness with improved toughness. The new bar steels have particular application to the production of air cooled forgings which do not require heat treatment, and to the direct production from bar stock of other products having high strength properties.

2. Background Art

Until the past few years, products forged from bar stock usually were quenched and tempered in order to attain desired strength levels and hardness, e.g., from about 225 to 350 BHN. More recently, hot rolled microalloyed bar steels have become available as an alternative to quenched and tempered steels. Microalloyed forging grade bar steels have been shown to have two distinct advantages. The desired strength levels can be attained in many applications without heat treatment which results in a cost savings that more than offsets the additional cost of microalloying. In addition, the forging parts exhibit more uniform cross-sectional hardnesses than parts forged from quenched and tempered steels.

Microalloying technology involves the addition of small quantities, less than about 0.25 percent, of vanadium or niobium to medium carbon steels, sometimes in combination with a small amount of nitrogen, to obtain enhanced mechanical and physical properties. It has been shown that for medium carbon steels with a fixed manganese content, yield strength, tensile strength and hardness increase almost linearly with increasing vanadium up to at least 0.20 percent. At lower carbon levels up to about 0.30 percent, niobium may be a more effective microalloying addition than vanadium. In some instances, niobium effectively can be combined with vanadium up to levels of about 0.10 percent vanadium to enhance strength and mechanical properties.

The carbon content of vanadium microalloyed steels typically ranges upward from about 0.02 percent with the carbon content of bar steels being in the range of from about 0.30 to about 0.50 percent. It has been recognized that an increase in carbon content is accompanied by a decrease in toughness and that higher carbon levels, e.g., above about 0.20 percent, can be employed to improve strength only when impaired toughness is acceptable.

It also has been found that vanadium additions can adversely affect toughness. The toughness of a microalloyed steel can be measured by its ductile-brittle fracture appearance transition temperature (F.A.T.T.), with lower F.A.T.T. temperatures indicating improved toughness. In general, the F.A.T.T. increases with increasing vanadium additions above about 0.05 percent. For vanadium contents between 0.10 and 0.20 percent, the F.A.T.T. is increased by 11°–15° F. per 0.01 percent vanadium.

DISCLOSURE OF THE INVENTION

The purpose of the present invention is to provide a forging grade, as-hot rolled, microalloyed bar steel which has strength and hardness levels characteristic of quenched and tempered steels, e.g., about 225–350 BHN, and is further characterized by improved toughness compared to conventional microalloyed bar steel. More particularly, it is a purpose of the invention to provide a vanadium or niobium microalloyed bar steel having a carbon content of about 0.30 percent or higher which combines strength and hardness with good toughness.

It has been discovered that the toughness of vanadium and niobium microalloyed bar stock in an as-hot rolled condition can be improved by small, controlled additions of aluminum and nitrogen. The preferred addition range of aluminum is from about 0.05 to about 0.11 percent, with the most preferred range being about 0.06 to about 0.10 percent. As will be made more apparent from the detailed discussion that follows, the addition of aluminum in the preferred ranges causes the 50 percent F.A.T.T. to fall to its lowest value. The drop in transition temperature to its lowest value with increasing amounts of aluminum is nearly linear. An addition of aluminum in excess of the preferred amount causes an increase of the 50 percent F.A.T.T. The preferred range of nitrogen is from about 0.007 to about 0.019 percent, with the most preferred range being about 0.009 to about 0.013 percent.

In accordance with the foregoing, the invention provides a forging grade, as-hot rolled bar steel characterized by an air-cooled hardness of about 225–350 BHN, and by a composition comprising a microalloying addition selected from the class consisting of from about 0.08–0.17 percent vanadium and from about 0.015–0.10 percent niobium, and further comprising aluminum in a range of from about 0.05–0.11 percent and nitrogen in a range of from about 0.007–0.019 percent.

In especially preferred embodiments, the aluminum ranges from about 0.06–0.10 percent, the vanadium ranges from about 0.08–0.12 percent, the niobium ranges from about 0.02–0.05 percent, and the nitrogen ranges from about 0.009–0.013 percent.

A preferred vanadium mircoalloyed steel of the invention consists essentially of from about 0.30–0.50 percent carbon, 0.30–1.90 percent and more preferably 1.35–1.65 percent manganese, 0.04 percent maximum phosphorus, 0.08 percent maximum sulfur, 0.15–0.35 percent silicon, 0.009–0.013 percent nitrogen, 0.08–0.17 percent vanadium, 0.05–0.11 percent aluminum, and the balance iron.

A preferred niobium microalloyed steel of the invention consists essentially of from about 0.37–0.45 percent carbon, 0.30–1.90 percent and more preferably 1.35–1.65 percent manganese, 0.04 percent maxiumum phosphorus, 0.08–0.13 percent sulfur, 0.02–0.35 percent silicon, 0.009–0.013 percent nitrogen, 0.015–0.10 percent niobium, 0.05–0.11 percent aluminum, and the balance iron.

The microalloyed bar steels of the invention can be used to advantage to produce forgings which combine good strength and hardness with improved toughness and yet do not require heat treatment. It is only necessary to control the reheating and forging process to reproduce the initial thermomechanical treatment and obtain the same levels of properties that existed in the hot rolled bar. Reheating temperatures should be adequate to assure that the vanadium or niobium carbonitrides are taken into solution, but not too high that an undesirable microstructure is formed. Heating temperatures of about 2200° to 2300° F. are typical. It is also preferred to air cool the forgings to approximately 1000°-1100° F. in order to maximize strength and hardness.

Other advantages and a fuller understanding of the invention will be more apparent from the following detailed description and the accompanying drawings.

BEST MODE FOR CARRYING OUT THE INVENTION

As generally described above, the invention involves the addition of small, but critical, amounts of aluminum and nitrogen to medium carbon microalloyed bar steels. Preferred steels are microalloyed with vanadium, although the practice of the invention also is applicable to niobium microalloyed compositions.

The carbon content can vary from about 0.30 to 0.50 percent and the vanadium from about 0.08 to 0.17 percent. In the case of steels having a carbon content of from about 0.30 to about 0.40 percent, the preferred vanadium range is from about 0.08 to 0.12 percent in order to attain a hardness of from about 229 to 302 BHN. In steels having a higher carbon content of from about 0.45 to 0.50 percent, the preferred vanadium range is from about 0.12 to 0.17 percent in order to attain a hardness of from about 285 to 341 BHN.

It has been discovered that toughness and impact properties can be significantly improved by the controlled addition of aluminum and nitrogen, while maintaining the good strength and hardness levels achieved by carbon and vanadium contents in the ranges indicated.

The preferred nitrogen content is from about 0.007 to 0.019 percent with the most preferred range being from about 0.009 to 0.013 percent.

The desired improvement in toughness is achieved by the controlled addition of aluminum in a critical range of from about 0.05 to 0.11 percent. Below this range only modest improvements in toughness are attained, and above this level the improvement decreases. Optimum toughness is achieved by an aluminum addition which varies with the vanadium content. Lower vanadium steels require higher aluminum additions, and higher vanadium steels require lower aluminum additions. For vanadium microalloyed steels in which the vanadium content ranges from 0.08 to 0.17 percent, the most preferred aluminum range is from about 0.06 to 0.10 percent.

The advantages and the practice of the invention are further demonstrated by the following specific examples.

A number of vanadium microalloyed steels were prepared having the compositions reported in Table I. The steels had vanadium contents of 0.10, 0.15 and 0.20 percent, and varying aluminum contents. Each composition was made as a 50 pound air melt cast in a 4 inch by 4 inch iron mold, reheated to 2250° F., and rolled to a 1.7 inch square bar with the finishing temperature being between 1830° and 1850° F.

Figure 1:
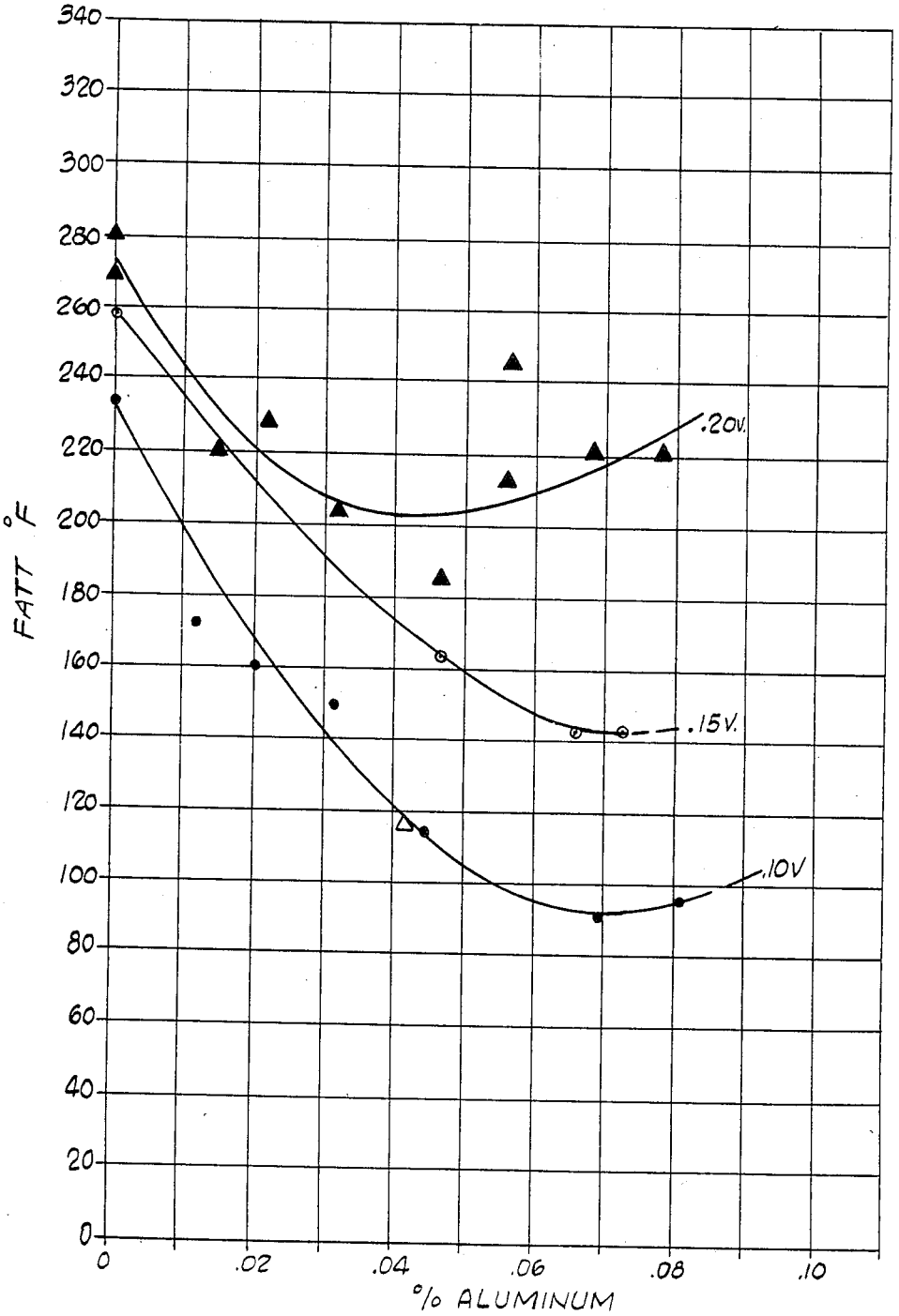
FIG. 1 is a graph of F.A.T.T. versus aluminum content of three vanadium microalloyed bar steels.

Table I lists the 50% F.A.T.T. in degrees Farenheit. This data is presented in FIG. 1. It will be seen that optimum toughness measured by 50% F.A.T.T. (with lowest temperatures indicating the best toughness) varied with the vanadium content. With a vanadium content of 0.10 percent, the optimum aluminum addition was 0.069 percent; with a vanadium content of 0.15 percent, the best toughness could be achieved with a slightly lower aluminum content of 0.065 percent; and with a vanadium content of 0.20 percent, the optimum aluminum addition was about 0.05 percent.

Figure 2:
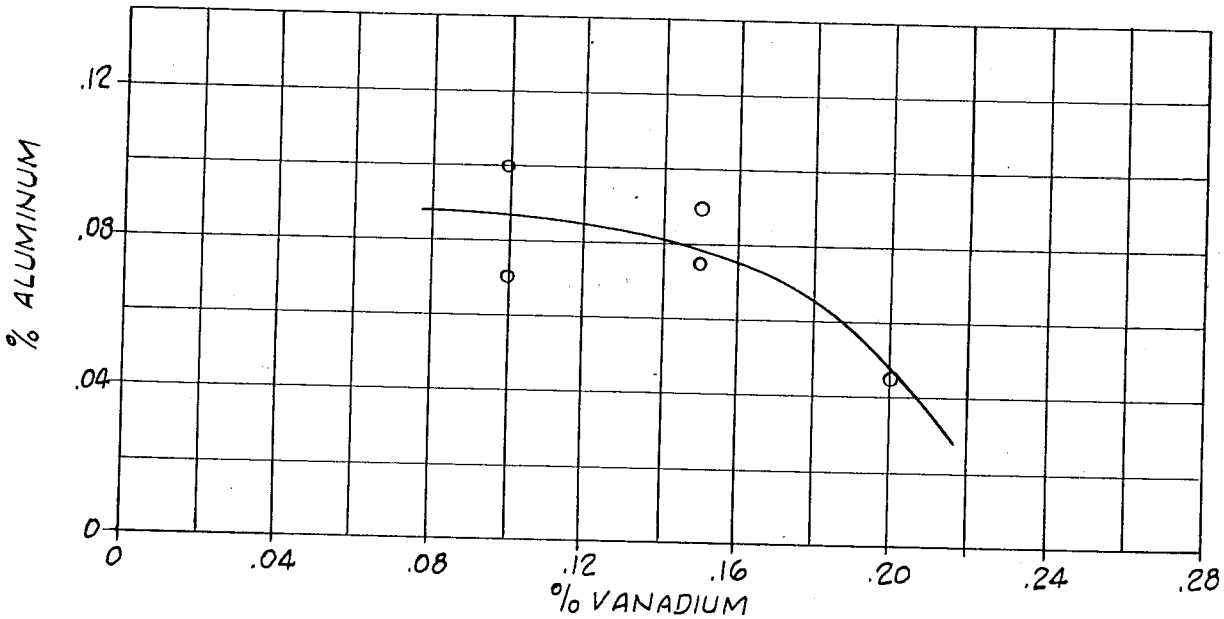
FIG. 2 is a graph of preferred aluminum contents versus vanadium content.

The graph of FIG. 2 shows optimum aluminum additions plotted against vanadium contents of 0.10, 0.15 and 0.20 percent. It will be seen from FIG. 2 that the preferred aluminum additions can be approximated as ranging from a low of 0.05 percent for a 0.20 percent vanadium steel to a high of about 0.09 or 0.10 percent for a 0.10 percent vanadium steel.

TABLE I

| Heat # | C | Mn | P | S | Si | V | Al | N | FATT-°F. |
|---|---|---|---|---|---|---|---|---|---|
| 7829 | .37 | 1.44 | .012 | .013 | .31 | .10 | — | .015 | 235 |
| 8079 | .35 | 1.48 | .010 | .012 | .22 | .10 | .012 | .015 | 168 |
| 8080 | .35 | 1.49 | .009 | .013 | .24 | .10 | .020 | .013 | 160 |
| 8081 | .35 | 1.50 | .010 | .013 | .25 | .10 | .032 | .012 | 152 |
| 7826 | .37 | 1.48 | .012 | .013 | .29 | .10 | .044 | .015 | 116 |
| 8082 | .35 | 1.50 | .010 | .009 | .22 | .10 | .069 | .012 | 91 |
| 7954 | .37 | 1.48 | .014 | .013 | .24 | .10 | .081 | .016 | 94 |
| 8011 | .35 | 1.46 | .012 | .010 | .24 | .15 | — | .016 | 260 |
| 7827 | .36 | 1.47 | .011 | .012 | .29 | .15 | .047 | .016 | 163 |
| 8001 | .41 | 1.35 | .013 | .012 | .27 | .15 | .065 | .014 | 143 |
| 8025 | .37 | 1.52 | .012 | .014 | .28 | .15 | .071 | .013 | 143 |
| 7830 | .35 | 1.47 | .013 | .013 | .28 | .21 | — | .016 | 280 |
| 7855 | .35 | 1.50 | .009 | .015 | .25 | .21 | — | .018 | 270 |
| 8083 | .36 | 1.48 | .011 | .010 | .22 | .20 | .015 | .014 | 220 |
| 8084 | .34 | 1.46 | .011 | .014 | .25 | .18 | .022 | .014 | 228 |
| 8085 | .34 | 1.49 | .010 | .010 | .25 | .22 | .032 | .014 | 204 |
| 7828 | .36 | 1.46 | .012 | .014 | .28 | .21 | .046 | .015 | 182 |
| 7951 | .37 | 1.47 | .015 | .014 | .25 | .20 | .056 | .015 | 212 |
| 7820 | .37 | 1.49 | .013 | .012 | .25 | .21 | .056 | .017 | 244 |
| 8086 | .35 | 1.49 | .009 | .011 | .26 | .20 | .068 | .015 | 220 |
| 7953 | .37 | 1.47 | .014 | .013 | .25 | .21 | .078 | .015 | 220 |

Table II lists the compositions and physical properties, including 50% F.A.T.T. and Charpy V-Notch results, of several bar steels microalloyed with niobium. It will be seen that in every instance the transition temperature was reduced on the order of 100° F. and the impact strength was significantly higher in the higher aluminum steels, i.e., those with an aluminum content of about 0.10-0.11 percent. Of great significance is the fact that even at −20° F., the impact strengths of the higher aluminum content steels exceeded the room temperature impact strengths of the lower aluminum content steels.

TABLE II

| Heat | Composition | | | | | | | | CVN Impact Properties (ft-lbs) | | | | Tensile Properties | | | |
|---|---|---|---|---|---|---|---|---|---|---|---|---|---|---|---|---|
| No. | C | Mn | P | S | Si | Al | N | Nb | FATT (°F.) | 72° F. | 0° F. | −20° F. | YS (ksi) | TS (ksi) | Pct Elong | Pct RA |
| A-377 | 0.39 | 1.46 | 0.014 | 0.015 | 0.18 | 0.001 | 0.009 | 0.041 | 236 | 4.7 | 2.5 | — | 67.0 | 113.4 | 20.8 | 48.0 |
| A-379 | 0.39 | 1.46 | 0.017 | 0.014 | 0.18 | 0.10 | 0.011 | 0.041 | 142 | 26.0 | 8.5 | 8.7 | 64.2 | 107.7 | 22.2 | 52.8 |
| A-378 | 0.42 | 1.45 | 0.014 | 0.016 | 0.11 | 0.001 | 0.007 | 0.080 | 224 | 4.5 | 2.2 | — | 67.7 | 114.2 | 20.8 | 45.6 |
| A-380 | 0.38 | 1.49 | 0.015 | 0.015 | 0.20 | 0.11 | 0.011 | 0.081 | 133 | 24.7 | 10.0 | 6.2 | 64.3 | 108.3 | 20.8 | 43.7 |
| A-381 | 0.39 | 1.48 | 0.015 | 0.081 | 0.19 | 0.003 | 0.009 | 0.041 | 174 | 5.2 | 2.7 | — | 65.2 | 108.2 | 19.5 | 39.4 |
| A-383 | 0.39 | 1.50 | 0.016 | 0.081 | 0.19 | 0.11 | 0.011 | 0.042 | 75 | 23.7 | 13.0 | 7.2 | 64.4 | 106.8 | 21.2 | 46.0 |
| A-382 | 0.40 | 1.48 | 0.014 | 0.081 | 0.23 | 0.003 | 0.009 | 0.082 | 197 | 4.5 | 2.7 | — | 69.6 | 114.1 | 17.5 | 34.2 |

TABLE II-continued

| Heat | Composition | | | | | | | | CVN Impact Properties (ft-lbs) | | | | Tensile Properties | | | |
|---|---|---|---|---|---|---|---|---|---|---|---|---|---|---|---|---|
| No. | C | Mn | P | S | Si | Al | N | Nb | FATT (°F.) | 72° F. | 0° F. | −20° F. | YS (ksi) | TS (ksi) | Pct Elong | Pct RA |
| A-384 | 0.42 | 1.43 | 0.014 | 0.081 | 0.15 | 0.12 | 0.011 | 0.081 | 42 | 30.5 | 9.5 | 8.0 | 61.6 | 105.0 | 21.2 | 45.6 |
| A-385 | 0.30 | 1.40 | 0.013 | 0.015 | 0.13 | 0.002 | 0.008 | 0.040 | 175 | 6.5 | 3.0 | — | 61.4 | 97.9 | 25.0 | 56.6 |
| A-387 | 0.31 | 1.46 | 0.013 | 0.014 | 0.14 | 0.10 | 0.011 | 0.041 | 84 | 48.2 | 25.0 | 18.2 | 63.0 | 98.5 | 24.5 | 54.3 |
| A-386 | 0.30 | 1.39 | 0.014 | 0.014 | 0.15 | 0.002 | 0.008 | 0.080 | 200 | 6.0 | 2.7 | — | 65.4 | 100.6 | 24.0 | 54.2 |
| A-388 | 0.27 | 1.46 | 0.013 | 0.014 | 0.18 | 0.11 | 0.012 | 0.082 | 102 | 45.8 | 21.7 | 18.2 | 64.9 | 96.7 | 25.0 | 58.5 |

It will thus be seen that the invention achieves the principal objective of unexpectedly improving the toughness of vanadium and columbium microalloyed medium carbon steels through the controlled addition of aluminum.

Various modifications and variations of the invention will be apparent from the foregoing detailed disclosure. Therefore, it is to be understood that, within the scope of the appended claims, the invention can be practiced otherwise than as specifically described.

We claim:

1. A forging grade, as-hot rolled bar steel characterized by an air-cooled hardness in a range of from about 225 to about 350 BHN, and further characterized by a composition consisting essentially of from about 0.30–0.50 percent carbon, 0.30–1.90 percent manganese, 0.04 percent maxiumum phosphorus, 0.08 percent maximum sulfur, 0.15–0.35 percent silicon, 0.007–0.019 percent nitrogen, 0.08–0.17 percent vanadium, 0.05–0.11 percent aluminum, and the balance iron.

2. A steel as claimed in claim 1 wherein the carbon is present in a range of from about 0.30–0.40 percent, and the vanadium is present in a range of from about 0.08–0.12 percent.

3. A steel as claimed in claim 3 wherein the carbon is present in a range of from about 0.45–0.50 percent, and the vanadium is present in a range of from about 0.12–0.17 percent.

4. A steel as claimed in any one of claims 1, 2 or 3 wherein the aluminum is present in a range of from about 0.06–0.10 percent.

5. A forging grade, as-hot rolled bar steel characterized by a hardness in a range of from about 225 to about 350 BHN, and further characterized b.y a composition consisting essentially of from about 0.37–0.45 percent carbon, 0.30–1.90 percent manganese, 0.04 percent maximum phosphorus, 0.08–0.13 percent sulfur, 0.02–0.35 percent silicon, 0.015–0.10 percent niobium, 0.007–0.019 percent nitrogen, 0.05–0.11 percent aluminum, and the balance iron.

6. A steel as claimed in claim 5 wherein the niobium is present in a range of from about 0.02–0.05 percent.

7. A steel as claimed in claim 5 or 6 wherein the aluminum is present in a range of from about 0.06–0.10 percent.

* * * * *